US005105496A

United States Patent [19]

Gray, Jr. et al.

[11] Patent Number: 5,105,496

[45] Date of Patent: Apr. 21, 1992

[54] SUCTION CLEANING DEVICE

[75] Inventors: Joseph S. Gray, Jr., San Francisco; Kenneth N. Marshall, Novato, both of Calif.

[73] Assignee: Arneson Products, Inc., Fairfield, Calif.

[21] Appl. No.: 600,005

[22] Filed: Oct. 18, 1990

[51] Int. Cl.[5] ..... E04H 3/20

[52] U.S. Cl. ..... 15/1.7

[58] Field of Search ..... 15/1.7; 134/21

[56] References Cited

U.S. PATENT DOCUMENTS

| | | | |
|---|---|---|---|
| 4,521,933 | 6/1985 | Raubenheimer | 15/1.7 |
| 4,536,908 | 8/1985 | Raubenheimer | 15/1.7 |
| 4,656,683 | 4/1987 | Raubenheimer | 15/1.7 |

*Primary Examiner*—Edward L. Roberts
*Attorney, Agent, or Firm*—Limbach & Limbach

[57] ABSTRACT

A suction cleaning device which is used for cleaning a swimming pool includes a removable door to improve access to the housing interior. The suction cleaning device is of the type having a primary and a secondary fluid flow path. The primary flow path has a primary turbine positioned in it for driving the device. The steering mechanism is of the type which has two secondary turbines which work together and comprise the secondary flow paths. The secondary fluid outlets, from the secondary flow paths are located near the primary turbine such that the secondary flow path joins the primary flow path. Access to the primary turbine is necessary to remove larger pieces of debris. A removable door having an opening aligned with the primary fluid inlet provides for access to the primary turbine. A screen integral with the removable door is preferably provided to prevent the entry of back wash debris into the lower secondary flow path. Screen guides provide for ease of replacement of the removable door.

13 Claims, 3 Drawing Sheets

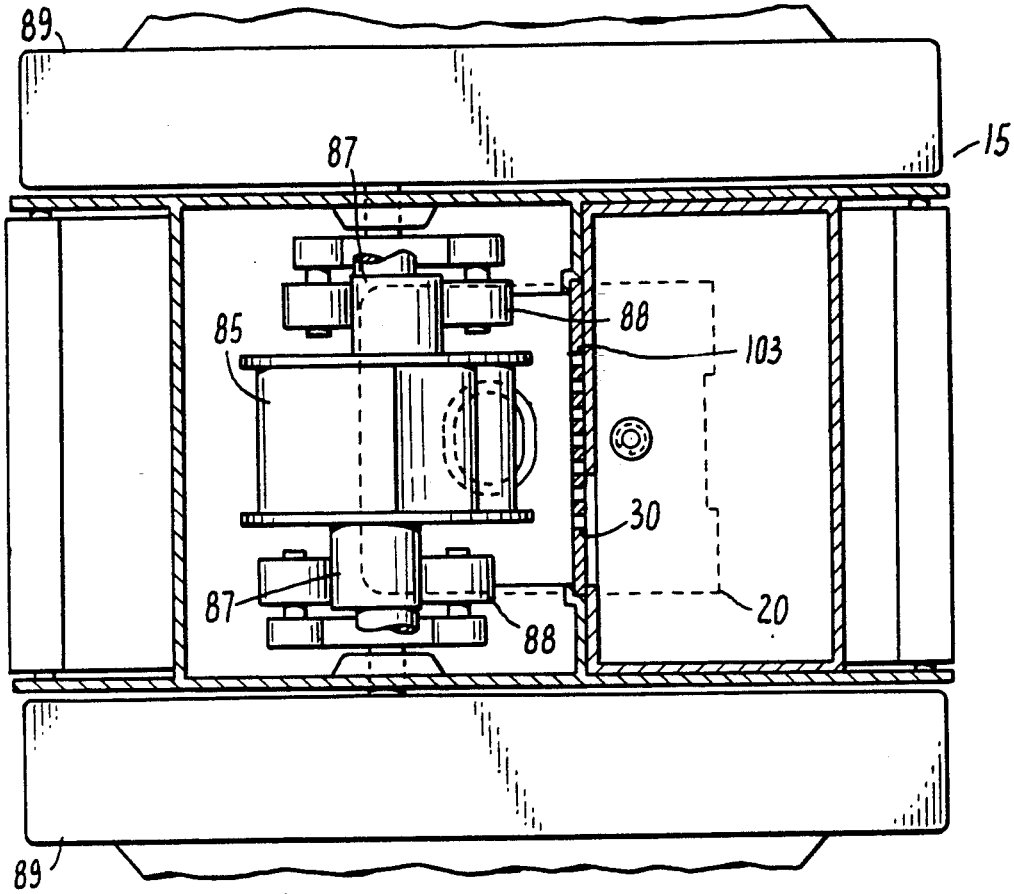
FIG. 4.
FIG. 3
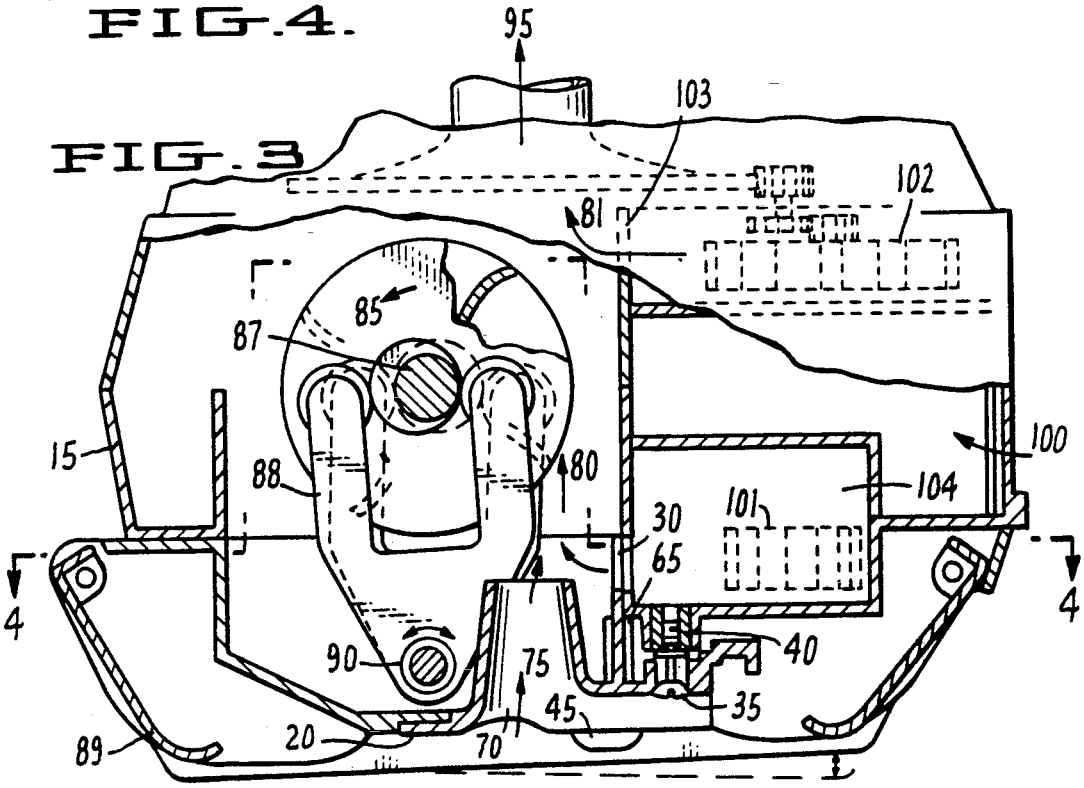

SUCTION CLEANING DEVICE

BACKGROUND OF THE INVENTION

This invention relates to known suction cleaning devices connectable to a suction source for use in a swimming pool. One such device is sold under the name "Pool Vac", a registered trademark of Arneson Products Corporation of Corte Madera, Calif. The improvements to such a device are the subject of this application.

The above cited suction cleaning device is fluid powered by a suction source. There are two fluid flow paths within the housing. The primary flow path contains the primary turbine which drives the device. The secondary flow path contains the secondary turbine which steers the device. The primary and secondary flow paths join at the inlet of the primary turbine such that water from the primary fluid inlet joins the water from the secondary fluid outlet just before entry into the primary turbine.

In the prior art suction cleaning device, access to the primary turbine is often required if hard debris, such as acorns, get sucked up into the underside of the device and jam the turbine. To clean the hard debris, the entire bottom housing assembly with four screws must be removed in order to gain access to the primary turbine. These screws are often removed pool side, that is, at the point of use of the suction cleaning device. The screws were apt to fall into the pool or otherwise be lost. Moreover, it was difficult to replace the bottom housing assembly since various components, such as the rocker arms, had to be aligned with other mating components.

In this prior art, the bottom housing assembly was designed with a few grooved paths for optimum operation in a concrete pool. This bottom housing assembly also had two downwardly projecting feet to keep the suction cleaning device from hanging up on the main drain or light fixtures located in the swimming pool.

Because of the possibility of tears and scratches, these feet are not desirable for vinyl pools and must be covered. Therefore, an additional screw mounted external plate, which covered the feet and had different channeling configurations, was added for vinyl pool operation. In addition, the plate placed the channeling configurations closer to the pool surface which increases suction and is desirable for vinyl pools, which are typically provided with smaller pumps for their suction source.

A third accessory, a venturi or restrictor throat, could be added for vinyl pools to maximize suction where small filter pumps were used. This extra piece was accommodated by inserting it into the housing bottom and sandwiching it in position by attachment of the external cover piece.

Prior art models also had a strainer in order to block debris from entering the output port of the steering mechanism. In operation, one component of the secondary fluid flow would come in through a separate opening and then out through this output port, past the primary turbine and into the main vacuum hose. At times when the suction source would be shut off, back pressure could force debris into this exit port which could jam the gear box and lower secondary turbine. The strainer limits the likelihood of occurrence of such jams.

SUMMARY OF THE INVENTION

The present invention overcomes all of the inherent deficiencies and limitations in the prior art devices. The devices of the present invention can be used with the suction cleaning devices known as the "Pool Vac", and the "Aquadroid", another product of Arneson Products Corporation of Corte Madera, Calif. These devices are of the type which employs two fluid paths—the first for driving the device and the second for steering it. The operation of such a device is described in U.S. Pat. No. 4,521,933, Raubenheimer, issued June 11, 1985, incorporated herein by reference.

The present invention has a rectangular cut-out portion in the bottom of the housing of the suction cleaning device. This rectangular cut-out portion acts as a removable door and can be mounted and retained with a single captured screw.

For vinyl swimming pools, an extra added external plate is attached to the removable door. Preferably this attachment is permanent such that the removable door and external plate become a single piece. This one unit can also be mounted and retained with the same captured screw. The external plate has through holes to accommodate other mounting screws.

For all models, there is provided grooved paths in the bottom of the device which facilitate delivery of the fluid to the primary fluid inlet.

Of particular significance is the integral mounting of the filter screen to the removable door. With this unique configuration, when the removable door is removed, the clearance area into the primary turbine is expanded to facilitate removal of debris. In addition, two channel guides, which receive the integral screen, provide precise alignment of the integral screen and removable door and insure easy reassembly of the device. This ability to exactly relocate the removable door contributes substantially to ease of disassembly and assembly.

The restrictor throat has been improved so that it can snap fit into the external plate. It includes an index tab as a directional guide to insure that it is placed in the correct direction, and a removal notch for snap out using a screwdriver.

It is an object of the present invention to provide easy access to the internal housing of the suction device for use in cleaning swimming pools.

Another object of this invention is to provide a means for cleaning of the primary flow path prior to fluid entry into the primary turbine.

Yet another object of the invention is to prevent back wash of particles into the secondary flow path when the device is turned off.

Still another object of the invention is to provide an integrated access and back wash screen for simultaneous removal and increase area of internal access upon removal.

Yet a further object of the invention is to create a central area within the primary flow path to facilitate removal of particulate that could plug the primary and secondary flow paths.

Another object of this invention is to provide easy access for a user to clean the central area of particulate collection.

It is still another object of this invention to provide a means for lifting the suction cleaning device away from the swimming pool thereby avoiding protrusions such as a main drain.

A further object of the present invention is to provide a means for close contact between the suction cleaning device and the bottom of the pool.

It is a further object of this invention to provide grooved paths in the bottom of the suction cleaning device to facilitate fluid entry.

Yet another object of the invention is to provide a restrictor throat to increase vacuum pressure to the suction cleaning device.

Other objects of the invention will become apparent upon reading the following specification and referring to the accompanying drawings.

BRIEF DESCRIPTION OF THE DRAWINGS

FIG. 3 is a cross sectional view, taken along the line 3—3 of FIG. 1 of the suction device for use in swimming pools showing the primary and secondary fluid flow paths;

FIG. 4 is a cross sectional view, taken along the line 4—4 of FIG. 3 of the suction device for use in swimming pools;

DESCRIPTION OF THE PREFERRED EMBODIMENTS

The present invention will be described here with reference to suction devices for use in swimming pools, and those of ordinary skill in the art will recognize the applications intended to be within the scope of the present invention.

Figure 1:
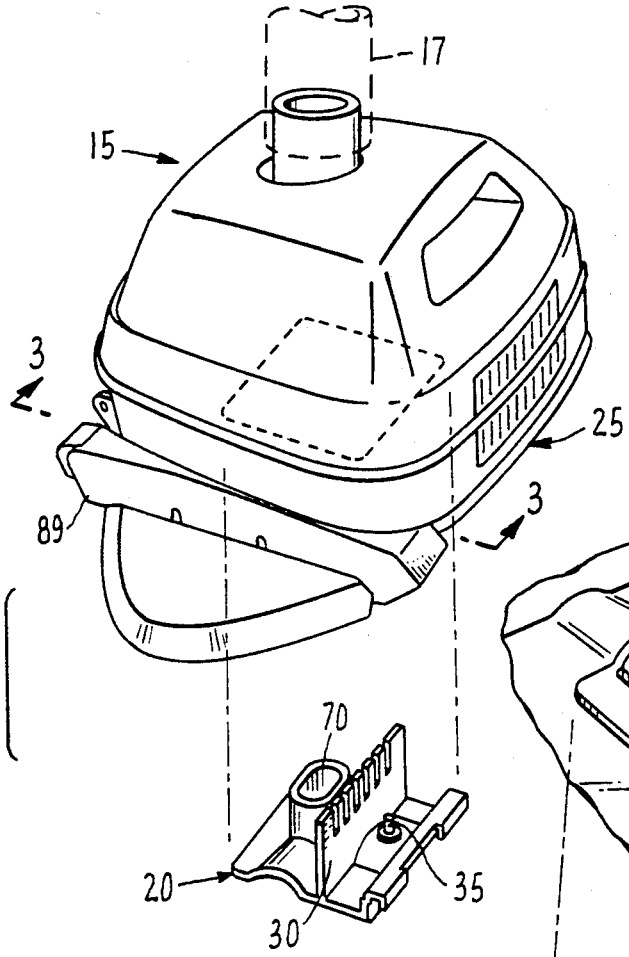
FIG. 1 is an exploded perspective view showing a suction device for use in swimming pools having a removable door with integral screen.
Figure 2:
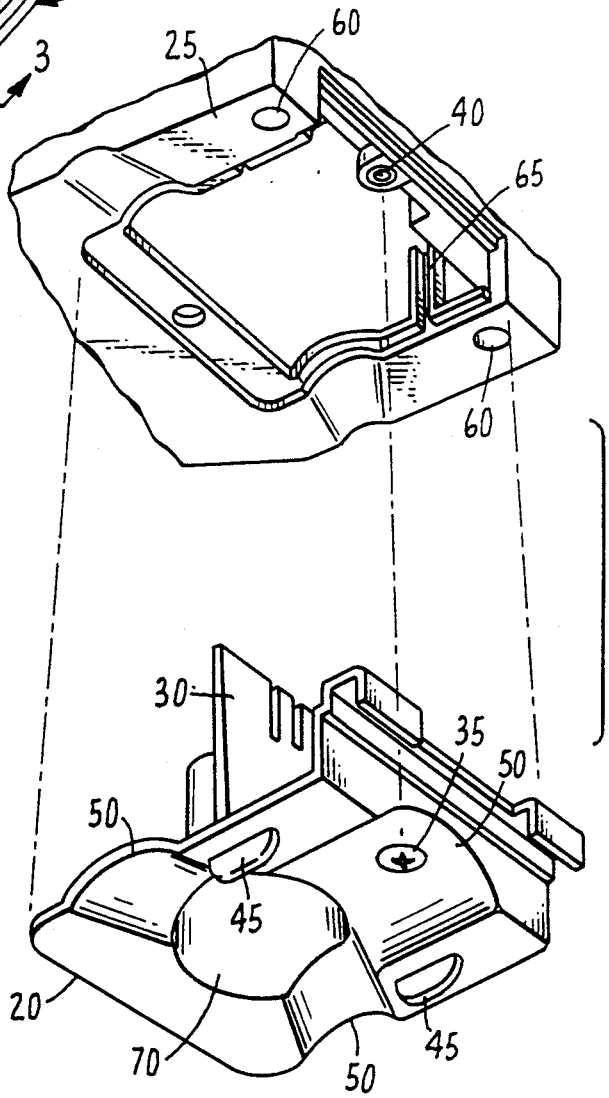
FIG. 2 is an enlarged exploded perspective view showing part of the bottom of the housing of the suction device for use in swimming pools with the removable door.

Referring now to FIGS. 1 and 2, there is shown a suction cleaning device 15 for use in a swimming pool. An exploded view of the removable door 20 and the housing 25 is shown. The integral screen 30 is shown next to the captured screw 35. These elements will be described in greater detail below.

Referring to FIG. 3, there is shown the primary and secondary fluid flow paths for a suction device for cleaning swimming pools. Water enters the primary flow path at the primary fluid inlet 75. It meets the fluid from one of the secondary fluid outlets 80, continues on past the primary turbine 85, and joins with the other secondary fluid outlet 81. The primary turbine is mounted on a shaft having an eccentric cam 87. As it turns, it turns the rocker arms 88 which are on pivots and which extend out to walking pods 89 which cause the suction device to move forward. The fluid from the primary and secondary flow paths is discharged at the primary fluid outlet 95 which is connected to the suction hose 17 as shown in FIG. 1.

In the secondary fluid flow paths, fluid enters at the secondary fluid inlet 100, passing through a pair of secondary turbines 101 and 102. The secondary turbine 101 is housed within a gearbox 104. The secondary turbines 101 and 102 work together to intermittently apply torque about the axis of the suction hose 17. The top secondary turbine 102 turns the suction hose 17 thereby providing the torque. The bottom secondary turbine 101 provides the change in direction of the torque applied by the top secondary turbine 102 by causing a reverse in the rotation of the top secondary turbine 102. This operation is similar to that described in U.S. Pat. No. 4,521,933, Raubenheimer.

The outlet from the bottom secondary turbine 101 passes through the integral screen 30 and out the secondary fluid outlet 80 at the inlet of the primary turbine 85. The outlet from the top secondary turbine 102 passes through internal screen 103 and out the secondary outlet 81 at the top of the primary turbine 85.

The captured screw 35 mounted in its mounting 40 rigidly positions and secures the removable door 20. The guide channels 65 fixedly position the filter screen 30 at the discharge of the bottom secondary turbine thereby preventing back wash from the primary turbine inlet from entering the secondary fluid outlet 80.

FIG. 2 shows a further detailed view of the removable door 20 with the integral screen 30. The removable door 20 fits into the bottom of the housing 25 and is rigidly attached by the captured screw 35 being fitted into its mounting 40. When the removable door 20 is placed in the bottom of the housing 25, the integral screen 30 slides into the guide channels 65 thereby fixedly positioning the screen in its exact desired location. During use, the removable door 20 is rigidly attached by the captured screw 35, and the downwardly projecting feet 45 keep the suction cleaning device 15 from contacting the bottom of the pool and being obstructed by, for example, the pool's main drain and/or light fixtures. The grooved paths 50 facilitate fluid and debris entry in through the inlet opening 70 to the primary flow path.

FIG. 4 shows a cross section of the suction cleaning device 15 ready for use. The location of the removable door 20 is outlined and is shown to be positioned over the entrance to the primary flow path and the primary turbine inlet.

If the suction device 15 jams, the device can be turned over and the captured screw 35 loosened. Loosening of the captured screw 35 permits removal of the removable door 20 and the integral screen 30. There is increased access room to the internal components of the device because the screen 30 is now automatically removed with the removable door 20. Debris can easily be cleared away. The removable door 20 is then exactly replaced by using the guide channels 65. This entire cleaning procedure can now be accomplished quickly and easily, and the device 15 put back into operation in a matter of minutes.

While the removable door 20 with downwardly extending feet 45 is optimum for hard surfaced pools such as concrete and the like, the downwardly projecting feet 45 may tear softer surfaced pools such as vinyl pools. For softer surfaced pools, it is necessary to protect the surface. The external plate 105 shown in FIG. 5 is used to cover the downwardly projecting feet 45 and protect the pool surface.

Moreover, typically, softer surfaced pools, such as vinyl pools, are provided with smaller pumps as their suction sources, so that increasing suction capability is desirable. By locating the bottom of the suction device closer to the vinyl surface, which is accomplished by installing the external plate 105, greater suction and better debris removal is available.

Figure 5:
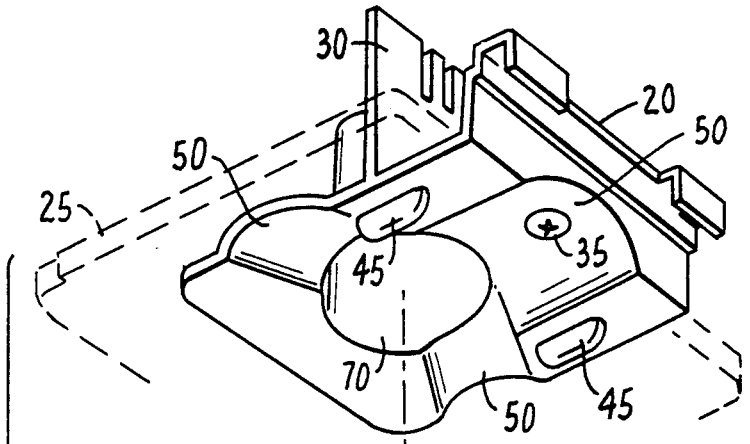
FIG. 5 is an exploded perspective view showing the suction device for use in swimming pools with the removable door with the integral screen, and the external plate and restrictor throat.
Figure 7:
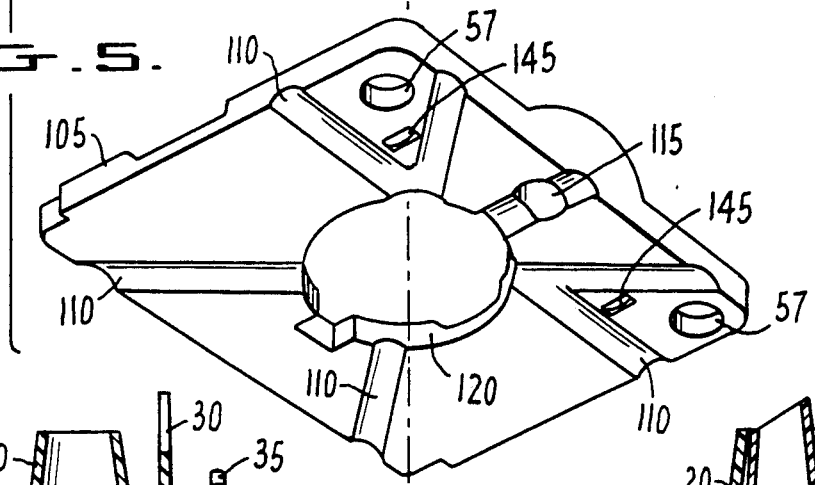
FIG. 7 is a cross sectional view taken along the line 7—7 of FIG. 6 of the external plate without a restrictor throat attached to a removable door for a suction device for use in swimming pools.
Figure 7:
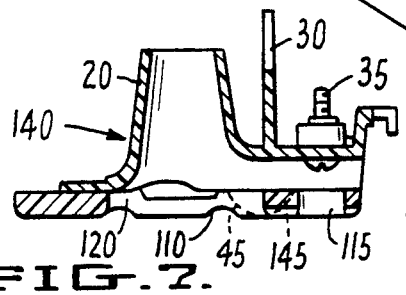
Figure 6:
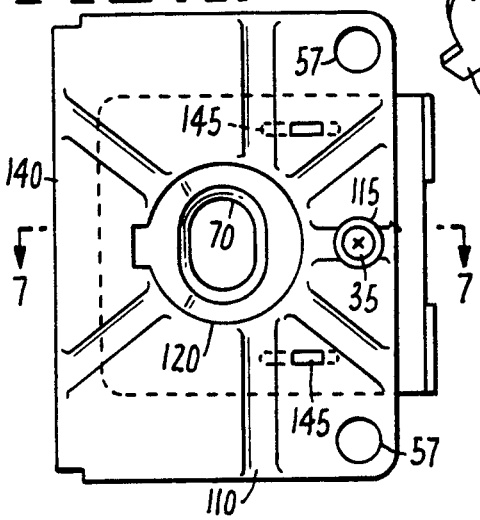
FIG. 6 is a bottom plan view of the external plate without a restrictor throat with partial schematic of a removable door for the suction device for use in swimming pools.

FIG. 5 shows an exploded view of the removable door 20 having an external plate 105 with slots 145 for receiving and covering the downwardly projecting feet 45. The external plate 105 is permanently mounted to the removable door 20 and the entire unit 140, as shown in FIGS. 6 and 7, is rigidly attached to the bottom of the housing 25 by the captured screw 35 of the removable door 20. The external plate 105 is provided with a through hole 115 for access to the captured screw 35. The external plate 105 is also provided with additional through holes 57 to accommodate access to other bottom screws (not shown).

As the grooved paths 50 of the removable door 20 are covered by the external plate 105, new grooved paths 110 are provided at the exterior of the external plate 105. A hole 120 permits entry of fluid into the primary flow path.

Figure 9:
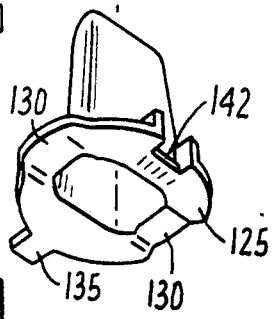
FIG. 9 is a cross sectional view, taken along the line 9—9 of FIG. 8 of the suction device for use in swimming pools having an external plate with a restrictor throat.
Figure 9:
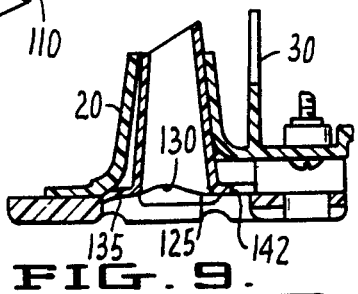
Figure 8:
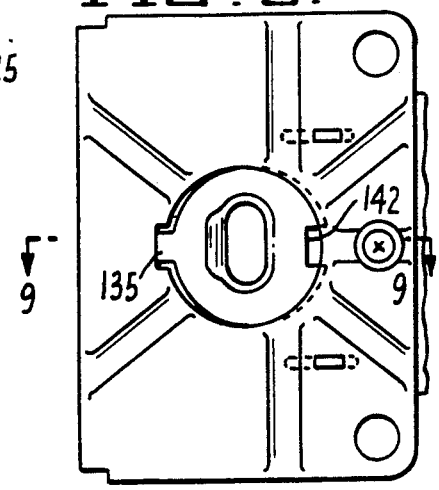
FIG. 8 is a bottom plan view of an external plate with restrictor throat and partial schematic of a removable door for the suction device for use in swimming pools.

In cases where there is not enough suction from the suction source, the restrictor throat 125, shown in FIGS. 5, 8 and 9, is used to increase the velocity of flow thereby concentrating and increasing the suction vacuum for those systems where not enough suction can be obtained with the standard orifice opening. The removable door/external plate assembly 140 may be used with or without the restrictor throat 125. The restrictor throat 125 is mounted in the inlet hole 120 of the external plate 105 where, when it is snapped in place, it is wedged between external plate 105 and removable door 20. It is further provided with grooved paths 130 which compliment the grooved paths 110 of the removable door 20, and also permit fluid entry through the inlet hole 120. A removal notch 142 opposes the directional guide 135. Both the removal notch 142 and the directional guide 135 are provided to insure that the restrictor throat 125 is installed in the proper direction and can be easily removed.

Installation of the restrictor throat 125 is now by snap fit. Previously it had to be sandwiched and secured between the housing bottom and the external plate. Removal of the restrictor throat required removing the screws which held the external plate in position, and removal of the external plate. It can now be installed externally to the external plate 105 by sliding it into the external inlet hole 120 and pressing down until it snaps into position between removable door 20 and external plate 105, all of which are now one assembly.

We claim:

1. A suction cleaning device connectable to a suction source for use in a swimming pool comprising:

a housing;

a primary fluid inlet in said housing;

a primary fluid outlet in said housing connectable to said suction source;

a primary flow path from the primary fluid inlet to the primary fluid outlet;

a primary turbine positioned in the primary flow path for driving the device;

a secondary fluid inlet in said housing;

a secondary fluid outlet in said housing;

a secondary flow path from the secondary fluid inlet to the secondary fluid outlet, with the secondary outlet being located near the primary turbine such that the secondary flow path joins the primary flow path;

a secondary turbine located in the secondary flow path for steering the device;

a removable door having an opening aligned with said primary fluid inlet, said removable door having an integral screen which projects inwardly in a manner to cover said secondary fluid outlet; and a means for attaching said removable door to said housing whereby removal of said removable door provides access to said primary turbine.

2. A suction cleaning device as recited in claim 1 wherein said means for attaching said removable door is a single connector means.

3. A suction cleaning device as recited in claim 2 wherein said single connector means is a captured screw.

4. A suction cleaning device as recited in claim 1 further comprising a channel guide means located adjacent the secondary fluid outlet for receiving and aligning said integral screen.

5. A suction cleaning device as recited in claim 4 wherein said channel guide means fixedly positions said removable door.

6. A suction cleaning device as recited in claim 1 wherein said integral screen is a planar screen.

7. A suction cleaning device as recited in claim 4, claim 5 or in claim 6 wherein said channel guide means is a pair of opposed channels for receiving said integral screen.

8. A suction cleaning device as recited in claim 1 said removable door further comprising downwardly projecting feet which provide spacing of the housing from the bottom of the pool.

9. A suction cleaning device as recited in claim 8 wherein said removable door is further provided with grooved paths for enhancing delivery to said primary fluid inlet.

10. A suction cleaning device as recited in claim 8 or claim 9 further comprising an external plate having an opening aligned with said primary fluid inlet and having slots for receiving and covering said feet.

11. A suction cleaning device as recited in claim 10 wherein said external plate is further provided with grooved paths for enhancing delivery of fluid to said primary fluid inlet.

12. A suction cleaning device as recited in claim 10 further having a restrictor throat for restricting fluid flow through said opening of said external plate, mounting means for fixedly positioning said restrictor throat within said opening and means for removing said restrictor throat from said opening.

13. A suction cleaning device as recited in claim 12 wherein said means for mounting and removing said restrictor throat is a snap fit means and deformation of said snap fit means, said deformation being implemented by placing pressure on said snap fit means causing the snap fit means to slide from its fixed position.

* * * * *